US011440320B2

(12) United States Patent
Mizuno

(10) Patent No.: US 11,440,320 B2
(45) **Date of Patent: *Sep. 13, 2022**

(54) LIQUID DISCHARGE HEAD

(71) Applicant: BROTHER KOGYO KABUSHIKI KAISHA, Nagoya (JP)

(72) Inventor: Taisuke Mizuno, Yokkaichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,701

(22) Filed: Dec. 8, 2020

(65) Prior Publication Data

US 2021/0086513 A1 Mar. 25, 2021

Related U.S. Application Data

(63) Continuation of application No. 16/433,547, filed on Jun. 6, 2019, now Pat. No. 10,864,728.

(30) Foreign Application Priority Data

Sep. 12, 2018 (JP) ..... JP2018-170938

(51) Int. Cl.
*B41J 2/14* (2006.01)
*B41J 2/18* (2006.01)

(52) U.S. Cl.
CPC ..... *B41J 2/14233* (2013.01); *B41J 2/18* (2013.01); *B41J 2002/14241* (2013.01);
(Continued)

(58) Field of Classification Search
CPC ..... B41J 2/14233; B41J 2202/11; B41J 2002/14241; B41J 2002/14459; B41J 2202/12; B41J 2/18
See application file for complete search history.

(56) References Cited

U.S. PATENT DOCUMENTS 8,820,895 B2 9/2014 Bibi et al.
10,864,728 B2 * 12/2020 Mizuno ..... B41J 2/14233
(Continued)

FOREIGN PATENT DOCUMENTS

JP 7-314670 A 12/1995
JP 2007-237470 A 9/2007
(Continued)

OTHER PUBLICATIONS

Office Action issued in parent U.S. Appl. No. 16/433,547 dated May 5, 2020.
(Continued)

*Primary Examiner* — Geoffrey S Mruk
(74) *Attorney, Agent, or Firm* — Merchant & Gould P.C.

(57) ABSTRACT

There is provided a liquid discharge head including: a first plate formed with an individual channel which includes a pressure chamber; a second plate; a vibration plate; and a piezoelectric element. The second plate has a pair of communicating channels arranged to sandwich an accommodating space, which accommodates the piezoelectric element, therebetween. A spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction.

14 Claims, 11 Drawing Sheets

(52) U.S. Cl.
CPC .. *B41J 2002/14459* (2013.01); *B41J 2202/11* (2013.01); *B41J 2202/12* (2013.01)

(56) References Cited

U.S. PATENT DOCUMENTS

| | | | |
|---|---|---|---|
| 2008/0180469 | A1 | 7/2008 | Katayama |
| 2016/0059557 | A1 | 3/2016 | Yoshioka et al. |
| 2017/0072692 | A1 | 3/2017 | Chen et al. |
| 2018/0194134 | A1 | 7/2018 | Kawakubo et al. |

FOREIGN PATENT DOCUMENTS

| | | | |
|---|---|---|---|
| JP | 2008-74034 | A | 4/2008 |
| JP | 2008-273001 | A | 11/2008 |
| JP | 2009-56752 | A | 3/2009 |
| JP | 2010-64481 | A | 3/2010 |
| JP | 2012-61717 | A | 3/2012 |
| JP | 2016-49680 | A | 4/2016 |
| JP | 2017-170784 | A | 9/2017 |
| JP | 2018-43447 | A | 3/2018 |
| JP | 2018-111216 | A | 7/2018 |
| WO | 2016/193749 | A1 | 12/2016 |

OTHER PUBLICATIONS

Notice of Allowance issued in parent U.S. Appl. No. 16/433,547 dated Aug. 13, 2020.
Notice of Reasons for Refusal issued in corresponding Japanese Patent Application No. 2018-170938, dated Mar. 29, 2022.

* cited by examiner

LIQUID DISCHARGE HEAD

CROSS REFERENCE TO RELATED APPLICATION

The present application is a continuation of U.S. patent application Ser. No. 16/433,547, filed Jun. 6, 2019, now U.S. Pat. No. 10,864,728, which claims priority from Japanese Patent Application No. 2018-170938, filed on Sep. 12, 2018. The entire disclosures of the aforementioned applications are incorporated herein by reference in their entirety.

BACKGROUND

Field of the Invention

The present disclosure relates to a liquid discharge head.

Description of the Related Art

As an apparatus having a conventional head, there is known an ink-jet printer having a chamber, an inlet port and an outlet port. The chamber is communicated with a nozzle at a lower part of the chamber, and the inlet port and the outlet port are formed in an upper part of the chamber at positions, respectively, which are separated away from each other.

Further, an actuator is provided at a location which is between the inlet port and the outlet port, and which is above the chamber via a vibration plate intervened between the actuator and the chamber. In such a head, an ink inflows into the chamber from the inlet port, and the vibration plate is deformed by the actuator to thereby allow the ink to be discharged from the nozzle via the chamber. Further, the ink (a portion of the ink) which is not discharged from the nozzle flows out from the chamber to the outlet port and thus is circulated.

In the above-described ink-jet printer, a partition wall is provided between the actuator and a flow channel (channel) which is connected to each of the inlet port and the outlet port. The partition wall prevents the ink from leaking from each channel to the actuator. In a case that the thickness of the partition wall is decreased in response to a demand for miniaturizing the head, there is such a fear that the ink might leak from the channel to the side of the actuator.

On the other hand, in a case that the thickness of the partition wall is increased while an attempt is being made to miniaturize the head, an inter-channel space between the channels becomes small, due to which the actuator and the vibration plate are consequently have to be miniaturized as well, thereby narrowing an active portion thereof to the extent of the miniaturization. This reduces the displacement of the vibration plate, thereby making an ink amount, of the ink which is discharged from the nozzle, be smaller than a desired ink amount.

The present disclosure has been made in order to solve the above-described task; an object of the present disclosure is to provide a head (liquid discharge head) capable of preventing the liquid from leaking to the piezoelectric element and suppressing any decrease in the discharge amount of the liquid, while suppressing any increase in the size of the head as a whole.

SUMMARY

According to an aspect of the present disclosure, there is provided a liquid discharge head including:

a first plate formed with an individual channel which communicates with a nozzle and which includes a pressure chamber;

a second plate stacked, in a stacking direction, on the first plate on a side opposite to the nozzle;

a vibration plate stacked between the first and second plates in the stacking direction; and a piezoelectric element which is arranged in the vibration plate at a position overlapping, as seen from the stacking direction, with the pressure chamber of the individual channel, wherein the second plate has:

an accommodating space accommodating the piezoelectric element, and a pair of communicating channels arranged to sandwich the accommodating space therebetween, each of the pair of communicating channels extending in the stacking direction, and communicating with the individual channel; and a spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction.

According to this configuration, since the accommodating space is stacked on the pressure chamber, and the vibration plate is provided between the accommodating space and the pressure chamber, the accommodating space and the vibration plate are arranged in the vicinity of the pressure chamber between the pair of circulating channels (pair of communicating channels). The spacing distance between the pair of circulating channels is made to be wider (greater) on one side, in the stacking direction, which is close to the pressure chamber than on the other side, in the stacking direction, which is far from the pressure chamber. With this, it is possible to secure the thickness of the partition wall between the accommodating space and the circulating channels and the width of the vibration plate to be both great, while suppressing any increase in the size of the liquid discharge head. Accordingly, it is possible to suppress any decrease in the discharge amount of the liquid, while preventing any leakage of the liquid.

The present disclosure has the configuration as described above, and achieves such effects of preventing the liquid from leaking to the piezoelectric element and suppressing any decrease in the discharge amount of the liquid, while suppressing any increase in the size of the liquid discharge head as a whole.

EMBODIMENT

An embodiment of the present disclosure will be specifically explained as follows, with reference to the drawings.

First Embodiment

<Configuration of Liquid Discharge Apparatus>

Figure 1:
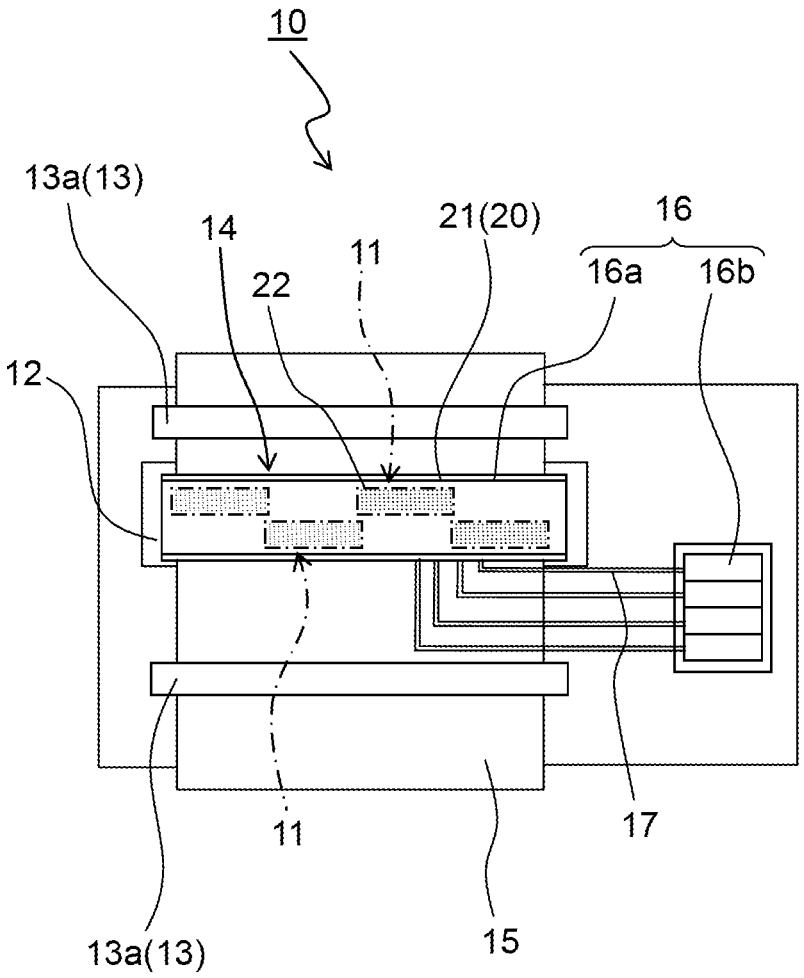
FIG. 1 is a view schematically depicting a liquid discharge apparatus provided with a head (liquid discharge head) according to a first embodiment.
Figure 1:
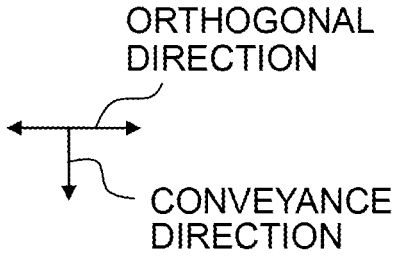

As depicted in FIG. 1, a liquid discharge apparatus 10 provided with a liquid discharge head 11 (hereinafter simply referred to as a "head 11") according to a first embodiment is an apparatus configured to discharge liquid, and is exemplified, for example, by an ink-jet printer. The liquid discharge apparatus 10 is provided with a platen 12, a conveying mechanism 13 and a line head 14.

The platen 12 is a stand or base on which paper 15 is placed. The conveying mechanism 13 has two conveying rollers 13*a* which are arranged so as to sandwich the platen 12 in a conveyance direction therebetween, and conveys the paper sheet 15 in the conveyance direction with these conveying rollers 13*a*.

The line head 14 has a length which is not less than a length, of the paper sheet 15, in a direction (orthogonal direction) orthogonal to a direction in which the paper sheet 15 is conveyed (conveyance direction). The line head 14 is provided with a plurality of pieces of the head 11. Each of the heads 11 has a discharge plate 20, a plurality of discharge ports 22 are opened in a discharge surface 21 of the discharge plate 20, and the plurality of discharge ports 22 are aligned in an alignment direction. The specifics of the head 11 will be described later on. Further, in the present embodiment, although the discharge ports 22 are aligned such that the alignment direction thereof is orthogonal to the conveyance direction, it is allowable that the alignment direction is made to cross the conveyance direction.

A tank 16 is connected to each of the discharge ports 22. The tank 16 has a sub tank 16*a* arranged on the line head 14, and a storing tank 16*b* connected to the sub tank 16*a* via a tube 17. A liquid is stored in the sub tank 16*a* and the storing tank 16*b*. The tank 16 is provided in accordance with the number of the color of liquid discharged from the discharge ports 22; for example, four pieces of the tank 16 are provided with respect to liquids of four colors (black, yellow, cyan and magenta). With this, the line head 14 discharges a plurality of kinds of the liquid.

In such a manner, the line head 14 is fixed to be unmovable, and discharges the liquids from the plurality of discharge ports 22. Accompanying with this discharging of the liquids, the conveying mechanism 13 conveys the paper sheet 15 in the conveyance direction, thereby recording an image, etc., on the paper sheet 15. Note that a serial head may be provided, instead of the line head 14.

<Configuration of Head>

Figure 2:
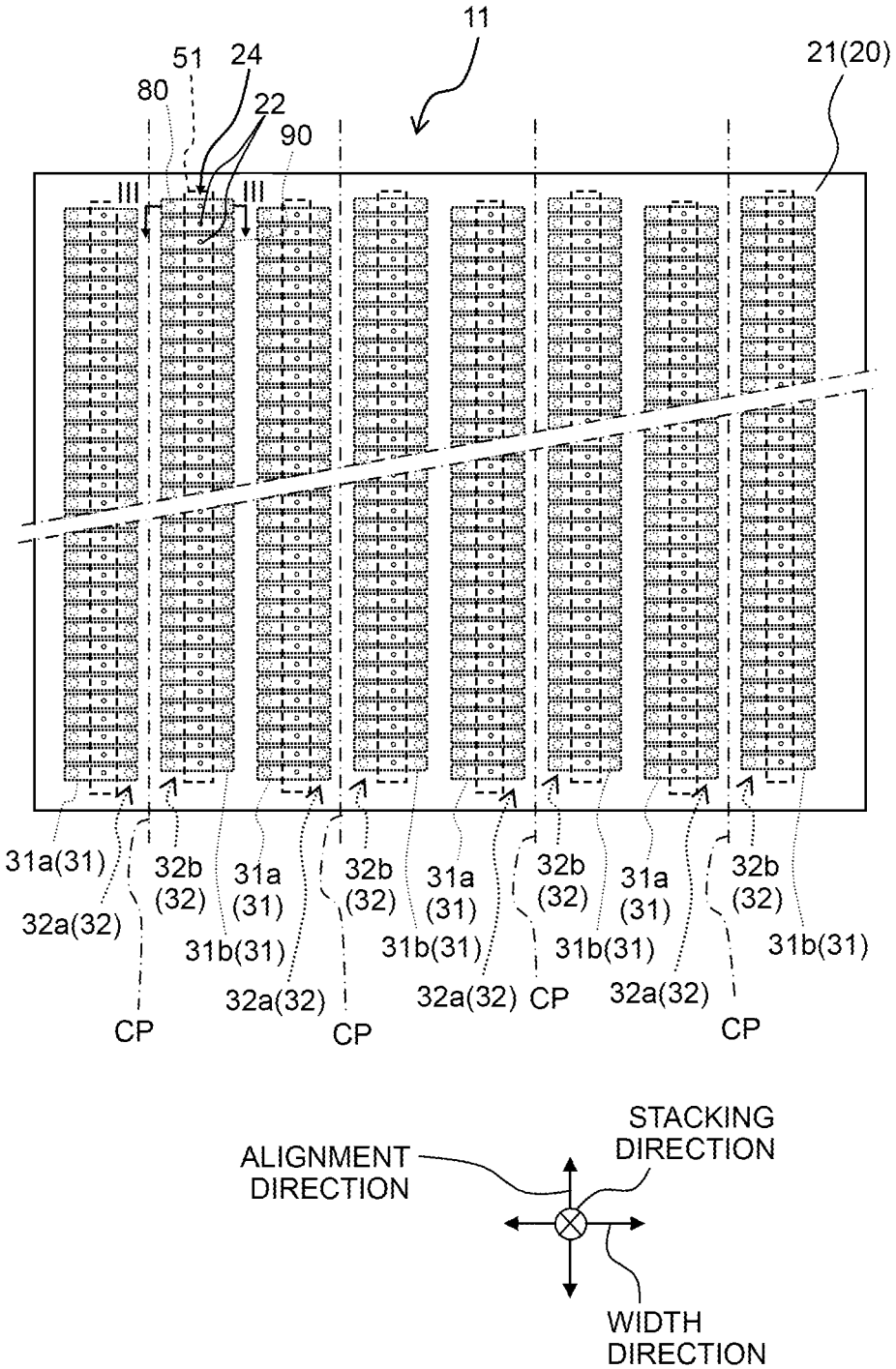
FIG. 2 is a view of the head in FIG. 1, as seen from a side of a discharging surface.
Figure 3:
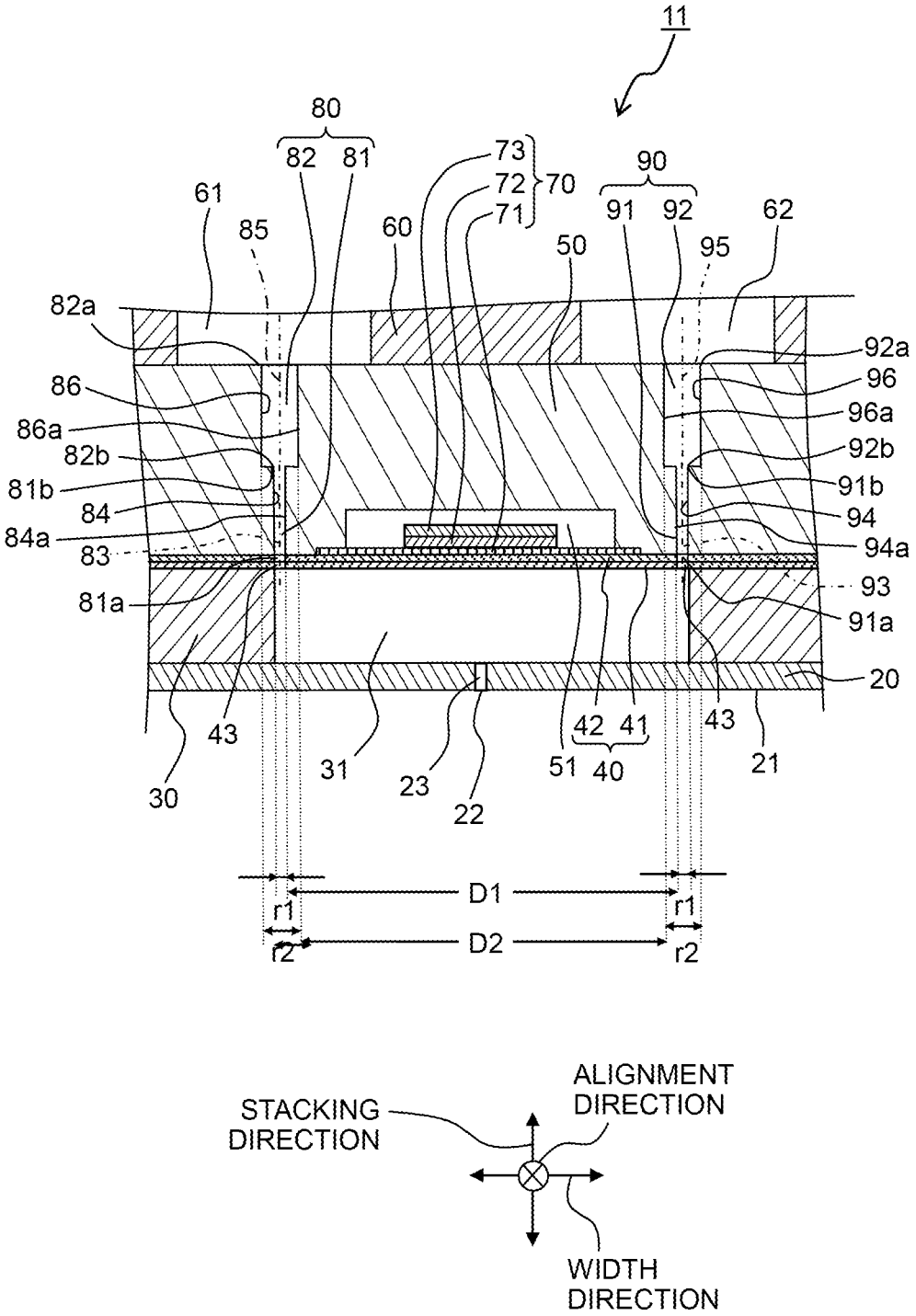
FIG. 3 is a cross-sectional view of a part of the head cut along a line in FIG. 2.

As depicted in FIGS. 2 and 3, the head 11 has a discharge plate 20, a first plate (pressure chamber plate 30), a vibration plate 40, a second plate (accommodating plate 50), and a manifold plate 60. Each of these plates is, for example, a rectangular-shaped flat plate, and is formed of a silicon, resin, or a metal.

The discharge plate 20, the pressure chamber plate 30, the vibration plate 40, the accommodating plate 50 and the manifold plate 60 are stacked in this order and are adhered to one another with an adhesive. A direction in which these plates are stacked (stacking direction) is orthogonal to the alignment direction and a width direction, and the width direction is orthogonal to the alignment direction. Note that the following explanation will be given with a side which is close to the discharge plate 20 than to the pressure chamber plate 30 in the stacking direction is defined as the lower side, and a side opposite to the lower side in the stacking direction is defined as the upper side. Note that, however, the arrangement of the head 11 is not limited to this.

The discharge plate 20 has a plurality of nozzles 23 which are formed to penetrate through the discharge plate 20 in the stacking direction. The lower surface of the discharge plate 20 is the discharge surface 21 in which the nozzle 23 are opened as openings. These openings are the plurality of discharge ports 22 from which the liquid is discharged.

The plurality of discharge ports 22 are aligned in the alignment direction so as to form a discharge port array 24. Number of the discharge port array 24 is, for example, 8 (eight), and the eight discharge port arrays 24 are arranged side by side in the width direction. A liquid of one color ink among the liquids of four colors is discharged from a pair of discharge port arrays 24 which are included in the eight discharge port arrays 24 and which are adjacent to each other in the width direction; the liquids of four colors (for example, black, yellow, cyan and magenta) are discharged from four pairs of the discharge port arrays 24, respectively.

The first plate is the pressure chamber plate 30 formed with a plurality of pressure chambers 31. The plurality of pressure chambers 31 are connected to the plurality of nozzles 23, respectively. Accordingly, the plurality of pressure chambers 31 are considered to be a part of individual channels, respectively, which are communicated with the plurality of nozzles 23 in one-to-one correspondence.

Note that the pressure chambers 31 are exemplified as the individual channels, respectively. Each of the individual channels is a channel communicating with one of the nozzles 23, and is formed in the pressure chamber plate 30. The individual channels are the channels which are provided corresponding to the nozzles 23, respectively, and are not limited to the pressure chambers 31.

Each of the pressure chambers 31 is formed to penetrate through the pressure chamber plate 30 in the stacking direction so as to communicate with one of the nozzles 23, and a side, of each of the pressure chambers 31, of one of the nozzles 23 is covered by the discharge plate 20. The pressure chamber 31 has, for example, a rectangular-parallelepiped shape, and has a length in the width direction which is longer than a length in the alignment direction. For example, the nozzle 23 is formed in each of the pressure chambers 31 at a central part thereof in the orthogonal direction orthogonal to the stacking direction.

8 (eight) pieces of the pressure chamber array 32 are arranged side by side in the width direction. Each of the eight pressure chamber arrays 32 has a plurality of pressure chambers 31 which are arranged (aligned) in the alignment direction. Among two pressure chamber arrays 32 which are included in the plurality of (eight) pressure chamber arrays 32 and which are adjacent to each other, one of the two pressure chamber arrays 32 is a first pressure chamber array 32*a* and the other of the two pressure chamber arrays 32 is a second pressure chamber array 32*b*. The first and second pressure chamber arrays 32*a* and 32*b* are connected to a same tank 16 among the four tanks 16 (see FIG. 1).

The vibration plate 40 is a plate which covers the side, of each of the pressure chambers 31, which is opposite to the side of the nozzle 23, and has, for example, an elastic film 41 and an insulation film 42. The elastic film 41 is elastically deformable in the stacking direction, and is arranged on the upper surface of the pressure chamber plate 30. The insulation film 42 is formed of an electrical insulative material, and covers the upper surface of the elastic film 41. The vibration plate 40 is provided with a connecting path 43 communicating with each of the pressure chambers 31.

The accommodating plate 50 is stacked on a side (upper side), of the pressure chamber plate 30, which is opposite to the side of the nozzles 23. The accommodating plate 50 is stacked on the upper surface of the vibration plate 40, and is provided with a pair of communicating channels (first communicating channel 80 and a second communicating channel 90), and an accommodating space 51. The first communicating channel 80 and the second communicating channel 90 are communicated with the pressure chamber 31 via the connecting path 43 of the vibration plate 40. The details of the first and second communicating channels 80 and 90 will be described later on.

The accommodating space 51 is an inner space of the accommodating plate 50, and is defined to be recessed upward from the lower surface of the accommodating plate 50 which faces the vibration plate 40. For example, the accommodating space 51 has a rectangular parallelepiped shape and extends to be long in the alignment direction so as to cover a plurality of piezoelectric elements 70 aligned in the alignment direction. Accordingly, the plurality of piezoelectric elements 70 are accommodated in the accommodating space 51.

The piezoelectric elements 70 are arranged at positions overlapping with the pressure chambers 31, respectively, via the vibration plate 40, as seen in the stacking direction. Each of the piezoelectric elements 70 has a common electrode 71, a piezoelectric body 72 and an individual electrode 73 which are stacked in this order. The common electrode 71 is an electrode common to the plurality of piezoelectric elements 70, and is staked on the upper surface of the vibration plate 40 so as to cover the vibration plate 40 substantially entirely. The piezoelectric body 72 and the individual electrode 73 are provided for each of the pressure chambers 31, and are stacked at a location above each of the pressure chambers 31.

In a case that voltage is applied to the individual electrode 73 of such a piezoelectric element 70, the piezoelectric body 72 is deformed to thereby cause the vibration plate 40 to displace in the stacking direction, in accordance with the deformation, toward the side of the pressure chamber 31, which in turn decreases the volume of the pressure chamber 31, applying the pressure to the liquid inside the pressure chamber 31 and thus causing the liquid to be discharged from the nozzle 23 communicating with the pressure chamber 31.

A plurality of manifolds are provided on the manifold plate 60. The plurality of manifolds include a plurality of first manifolds 61 and a plurality of second manifolds 62 which are arranged side by side to one another in the width direction.

Each of the first manifolds 61 extends in the alignment direction, and is communicated with the respective first communicating channels 80 aligned in the alignment direction. Each of the second manifolds 62 extends in the alignment direction, and is communicated with the respective second communicating channels 90 aligned in the alignment direction. Further, each of the first manifolds 61 and each of the second manifolds 62 are connected to the sub tank 16*a*.

With this, the liquid inflows from the storing tank 16 to the first manifold 61 via the sub tank 16, and then is supplied from the first manifold 61 to each of the pressure chambers 31 via one of the first communicating channels 80. Then, a part or portion of the liquid is discharged from each of the pressure chambers 31 via one of the nozzles 23. On the other hand, another part, of the liquid, which is not discharged, is discharged (exhausted) from each of the pressure chambers 31 to the sub tank 16*a*, via one of the second communicating channels 90 and further via the second manifold 62.

In such a manner, the first manifold 61, the first communicating channel 80, the pressure chamber 31, the second communicating channel 90 and the second manifold 62 form a circulating path via which the liquid is circulated. In this circulating path, the first communicating channel 80 is a supplying path via which the liquid flows from the first manifold 61 toward the pressure chamber 31, and the second communicating channel 90 is a returning path via which the liquid flows from the pressure chamber 31 toward the second manifold 62. Note that the first communicating channel 80 may be the returning path and the second communicating channel 90 may be the supplying path.

<Configurations of First and Second Communicating Channels>

One piece of the first communicating channel 80 and one piece of the second communicating channel 90 which make a pair are arranged in the width direction so as to sandwich the accommodating space 51 therebetween. Clearance (spacing distance) is defined each between the first communicating channel 80 and the accommodating space 51 and between the second communicating channel 90 and the accommodating space 51, and a partition wall is provided in the clearance.

The first communicating channel 80 and the second communicating channel 90 are provided for each of the pressure chambers 31, and are arranged to overlap with, in the stacking direction, and to communicate with each of the pressure chambers 31; the first communicating channel 80 and the second communicating channel 90 penetrate the accommodating plate 50 in the stacking direction.

The first communicating channel 80 extends in the stacking direction, has one end (lower end 81*a*) which is connected to the pressure chamber 31 via the connection path 43, and the other end (upper end 82*a*) which is connected to the first manifold 61. The second communicating channel 90 extends in the stacking direction, has one end (lower end 91*a*) which is connected to the pressure chamber 31 via the connection path 43, and the other end (upper end 92*a*) which is connected to the second manifold 62.

In the width direction, the lower end 81*a* of the first communicating channel 80 is connected to one end part in the longitudinal direction of the pressure chamber 31*a*, and the lower end 91*a* of the second communicating channel 90 is connected to the other end part in the longitudinal direction of the pressure chamber 31*a*. With this, the pair of communicating channels are connected to the ends, respectively, in the longitudinal direction (width direction) of the pressure chamber. With this, for example, the liquid inflows from the first communicating channel 80 into the one end of the pressure chamber 31 and flows out from the other end of the pressure chamber 31 into the second communicating channel 90. Accordingly, the liquid is allowed to flow from the one end up to the other end in the longitudinal direction of the pressure chamber 31, thus making is possible to suppress such a situation that the liquid remains in the pressure chamber 31.

Further, the upper end 92*a* of the second communicating channel 90 (returning path) is connected to a central part in the short direction (width direction) of the second manifold 62. With this, since the flow velocity of the liquid is faster at a position closer to the central part in the short direction of the second manifold 62, it is possible to discharge any air bubbles entered into and mixed with the liquid from the second communicating channel 90 into the second manifold 62. Thus, it is possible to prevent the flow of the liquid from being impeded by the air bubbles.

Further, the first communicating channel 80 has a first channel part 81 and a second channel part 82. For example, the first channel part 81 is cylindrical-shaped and has a central axis (central axis 83) extending in the stacking direction, and a first inner circumferential surface 84 surrounding the central axis 83, and has a diameter (first radius r1) which is a dimension in a direction orthogonal to the stacking direction and which is constant in the stacking direction. The first channel part 81 has an open end (lower end 81*a*) which is opened in the lower surface of the accommodating plate 50 and an upper end 81*b* which is on a side opposite to the lower end 81*a*.

For example, the second channel part 82 is cylindrical-shaped and has a central axis (central axis 85) extending in the stacking direction, and a second inner circumferential surface 86 surrounding the central axis 85, and has a diameter (second radius r2) which is a dimension in the direction orthogonal to the stacking direction and which is constant in the stacking direction. The second channel part 82 has an open end (upper end 82*a*) which is opened in the upper surface of the accommodating plate 50 and a lower end 82*b* which is on a side opposite to the upper end 82*a*.

The first channel part 81 is located at a position below the second channel part 82, and the upper end 81*b* of the first channel part 81 and the lower end 82*b* of the second channel part 82 are connected to each other. With this, the first channel part 81 and the second channel part 82 are communicated with each other. Accordingly, it is possible to form the first communicating channel 80, for example, by performing etching to form the first channel part 81 from the lower surface of the accommodating plate 50, and by performing etching to form the second channel part 82 from the upper surface of the accommodating plate 50.

In the stacking direction, the dimension or size (height) of the first channel part 81 is greater than the height of the accommodating space 51, and the second channel part 82 is located at a position above the accommodating space 51. With this, a partition wall is provided between the first channel part 81 and the accommodating space 51.

The central axis 83 of the first channel part 81 and the central axis 85 of the second channel part 82 are coaxial, and form the central axis of one piece of the first communicating channel 80. The first radius r1 of the first channel part 81 is smaller than the second radius r2 of the second channel part 82. Accordingly, a cylindrical-shaped stepped part (surface) is provided between the first channel part 81 and the second channel part 82, and the first inner circumferential surface 84 of the first channel part 81 and the second inner circumferential surface 86 of the second channel part 82 are connected to each other by the cylindrical-shaped stepped surface (part).

The second communicating channel 90 also has a first channel part 91 and a second channel part 92. Since the first channel part 91, a lower end 91*a*, an upper end 91*b*; the second channel part 92, an upper end 92*a*, an lower end 92*b*; a central axis 93, a first inner circumferential surface 94; and a central axis 95, a second inner circumferential surface 96 of the second communicating channel 90 are similar to the first channel part 81, the lower end 81*a*, the upper end 81*b*; the second channel part 82, the upper end 82*a*, the lower end 82*b*; the central axis 83, the first inner circumferential surface 84; and the central axis 85, the second inner circumferential surface 86 of the first communicating channel 80, respectively, the explanation therefor will be omitted.

With the above-described configuration, in the width direction, the first channel part 81 and the first channel part 91 are arranged side to side with each other with a spacing distance therebetween, and the second channel part 82 and the second channel part 92 are arranged side to side with each other with a spacing distance therebetween. The accommodating space 51 is arranged in a central location between the first channel part 81 and the first channel part 91, and the spacing distance between the lower end 81*a* of the first channel part 81 and the accommodating space 51 is equal to the spacing distance between the lower end 91*a* of the first channel part 91 and the accommodating space 51. The first radius r1 of each of the first channel part 81 and the first channel part 91 is smaller than the second radius r2 of each of the second channel part 82 and the second channel part 92. For example, the first radius r1 is 35 μm and the second radius r2 is 50 μm.

Here, a spacing distance (interval) between a part (first close part 84*a*) which is included in the first inner circumferential surface 84 of the first channel part 81 and which is closest to the first channel part 91 and a part (first close part 94*a*) which is included in the first inner circumferential surface 94 of the first channel part 91 and which is closest to the first channel part 81 is defined as a first distance D1. Further, a spacing distance (interval) between a part (second close part 86*a*) which is included in the second inner circumferential surface 86 of the second channel part 82 and which is closest to the second channel part 92 and a part (second close part 96*a*) which is included in the second inner circumferential surface 96 of the second channel part 92 and which is closest to the second channel part 82 is defined as a second distance D2. For example, the first distance D1 is 500 μm and the second distance D2 is 485 μm.

The first distance D1 is the shortest distance in the spacing distance between the first channel part 81 and the first channel part 91, and the second distance D2 is the shortest distance in the spacing distance between the second channel part 82 and the second channel part 92. In this case, the first distance D1 is wider than the second distance D2. Further, in the width direction, the partition wall set to the first distance D1 is also wider than the partition wall set to the second distance D2. Accordingly, the spacing distance between the parts which are mutually close to each other (mutually close parts) in the inner circumferential surface of the pair of communicating channels is made to be wider on a side of one ends (lower ends 81*a*, 91*a*), which are closer to the individual channel in the stacking direction of the communicating channels 80 and 90 than on a side of the other ends (upper ends 82*a*, 92*a*), which are farther from the individual channel than the one ends in the stacking direction, of the pair of communicating channels 80 and 90.

With this, it is possible to secure the dimensions (sizes) of the partition wall between the first channel part 81 and the accommodating space 51 and of the partition wall between the second channel part 91 and the accommodating space 51, while suppressing any increase in the size of the head 11 and suppressing any decrease in the dimension of the accommodating space 51 in the width direction. Owing to this, it is possible to prevent the liquid flowing through the first channel part 81 and the second channel part 91 from leaking to the accommodating space 51. Further, the active portions of the piezoelectric element 70 and the vibration plate 40 are not made to be small, thereby making it possible to prevent an amount of the liquid to be discharged from the nozzle 23 from becoming smaller than a desired discharge amount.

First Modification

Figure 4:
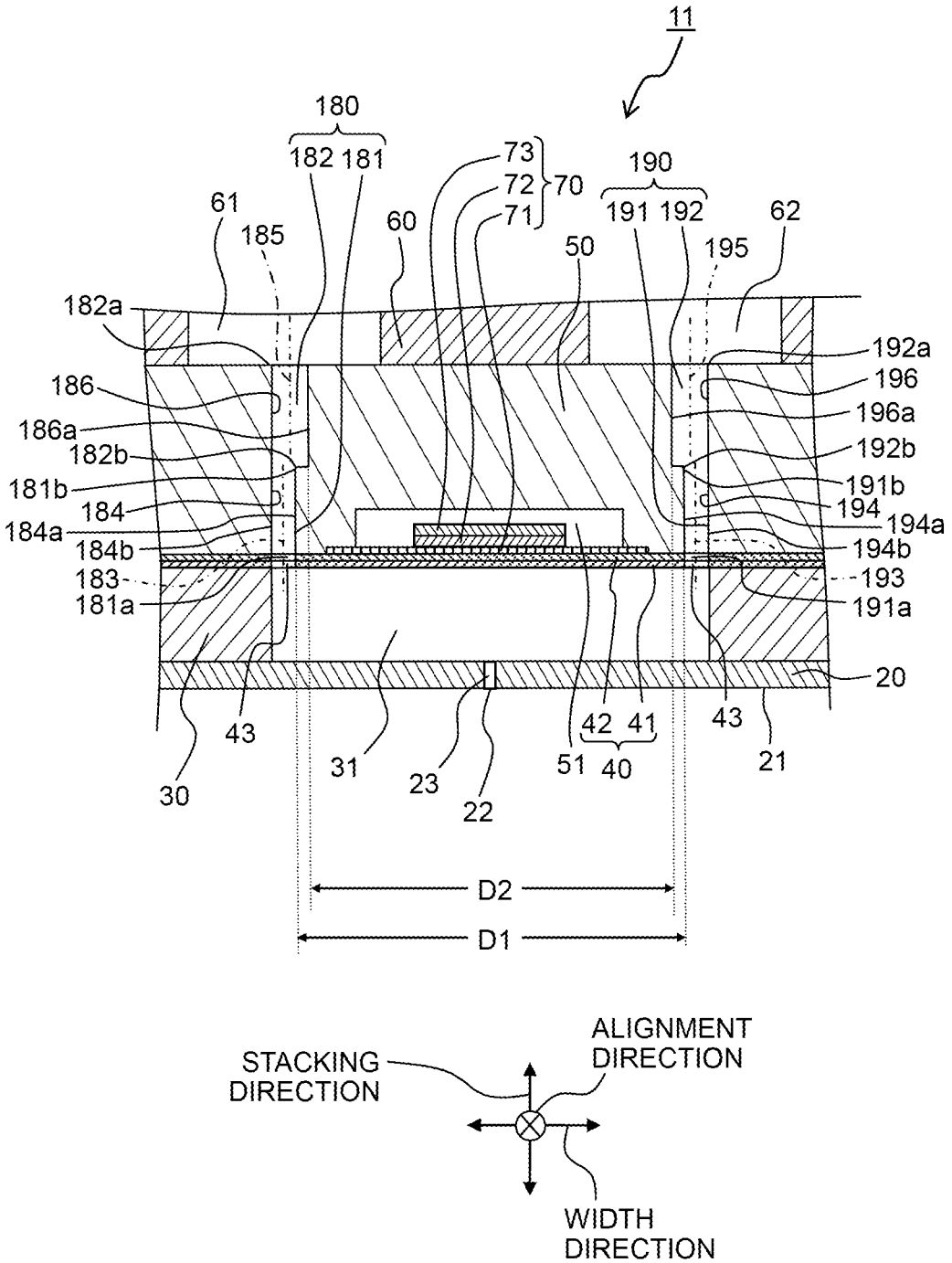
FIG. 4 is a cross-sectional view of a head according to a modification of the first embodiment.

In FIG. 3 as described above, the central axis 83 and the central axis 85 are coaxial in the first communicating channel 80 and the central axis 93 and the central axis 95 are coaxial in the second communicating channel 90. However, the positional relationship among the respective axes is not limited to this. For example, as depicted in FIG. 4, a pair of first channel parts 181, 191 and a pair of second channel parts 182, 192 may be arranged such that a distance between a central axis 183 and a central axis 193 of the pair of first channel parts 181 and 191 is greater than a distance between a central axis 185 and a central axis 195 of the pair of second channel parts 182 and 192.

Specifically, the first communicating channel 180 has a lower end 181*a* and an upper end 182*a*; and the first channel part 181 and the second channel part 182 are connected to each other by an upper end 181*b* of the first channel part 181 and a lower end 182*b* of the second channel part 182. The second communicating channel 190 has a lower end 191*a* and an upper end 192*a*; and the first channel part 191 and the second channel part 192 are connected to each other by an upper end 191*b* of the first channel part 191 and a lower end 192*b* of the second channel part 192.

The central axis 183 of the first communicating channel 180 is arranged on the side opposite to the side of the second communicating channel 190 with respect to the central axis 185. The central axis 193 of the second communicating channel 190 is arranged on the side opposite to the side of the first communicating channel 180 with respect to the central axis 195. With this, a first distance D1 between a first close part 184*a* and a first close part 194*a* is wider than a second distance D2 between a second close part 186*a* and a second close part 196*a*.

Here, a part (first separated part 184*b*) which is included in the first inner circumferential surface 184 of the first channel part 181 in the first communicating channel 180 and which is the farthest, in the width direction, from the second communicating channel 190, and a part (second separated part 186*b*) which is included in the second inner circumferential surface 186 of the second channel part 182 in the first communicating channel 180 and which is the farthest, in the width direction, from the second communicating channel 190 are arranged such that the first separated part 184*a* and the second separated part 186*b* are arranged side by side linearly in the stacking direction. Similarly, a part (first separated part 194*b*) which is included in the first inner circumferential surface 194 of the first channel part 191 in the second communicating channel 190 and which is the farthest, in the width direction, from the first communicating channel 180, and a part (second separated part 196*b*) which is included in the second inner circumferential surface 186 of the second channel part 192 in the second communicating channel 190 and which is the farthest, in the width direction, from the first communicating channel 180 are arranged such that the first separated part 194*a* and the second separated part 196*b* are arranged side by side linearly in the stacking direction. Accordingly, the first distance D1 is wider than the second distance D2.

As described above, the spacing distance between the mutually close parts in the pair of inner circumferential surfaces of the pair of communicating channels is made to be wider on the side of one ends (lower ends 181*a*, 191*a*), of the communicating channels 180 and 190, which are close to the individual channel in the stacking direction than on the side of the other ends (upper ends 182*a*, 192*a*) of the communicating channels 180 and 190. Accordingly, it is possible to prevent the liquid from leaking to the piezoelectric element 70 and to suppress any decrease in the discharge amount of the liquid, while suppressing any increase in the size of the head 11 as a whole.

Further, in the width direction, the first channel part 181 is located closer toward the end, of the second channel part 182 of the first communicating channel 180, which is on the side opposite to the side of the second communicating channel 190, and the first channel part 191 is located closer toward the end, of the second channel part 192 of the second communicating channel 190, which is on the side opposite to the side of the first communicating channel 180. Accordingly, it is possible to secure the first distance D1 to be the widest in a range wherein the first channel parts 181, 192 are overlapped in the stacking direction with the second channel parts 182, 192, respectively. Consequently, it is possible to further prevent the leakage of the liquid and to further suppress any decrease in the discharge amount of the liquid.

Second Embodiment

Figure 5:
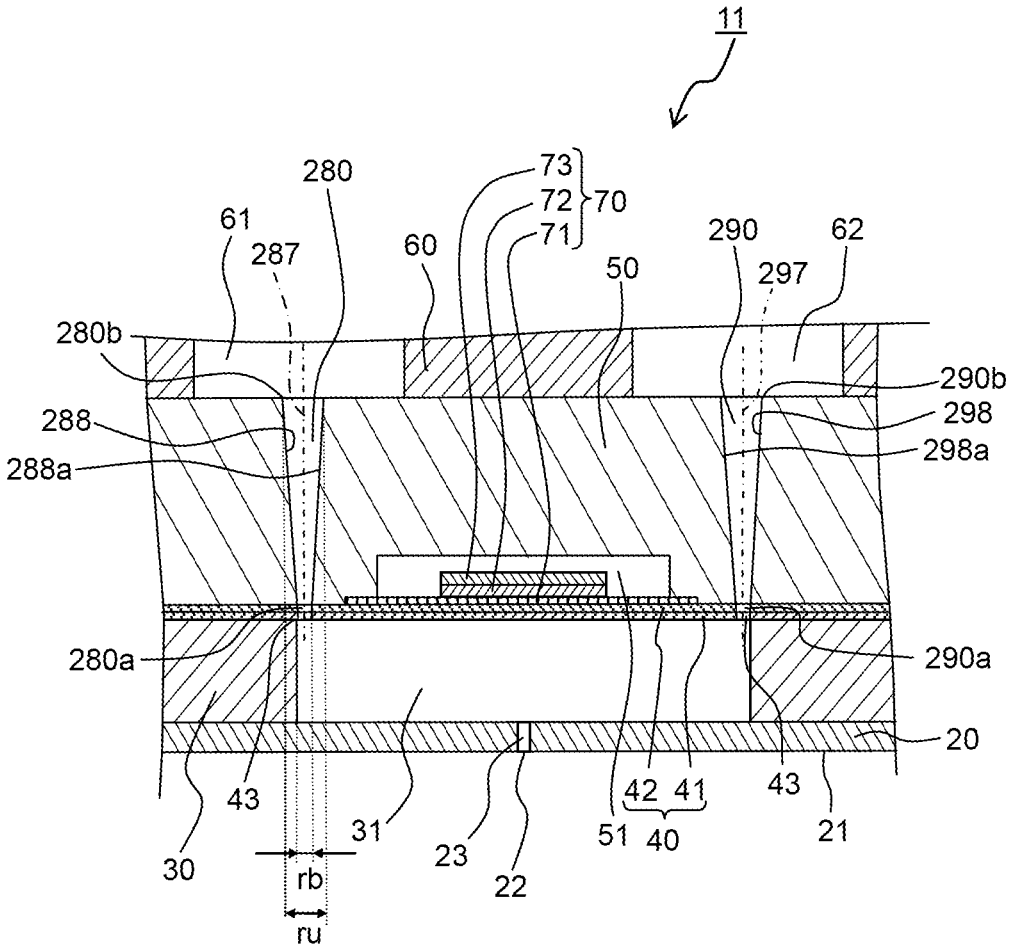
FIG. 5 is a cross-sectional view of a head according to a second embodiment.
Figure 5:
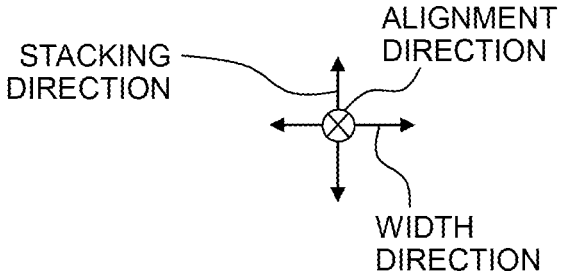

A head 11 according to a second embodiment is similar to the head 11 of the first embodiment as described above, except for the shapes of a first communicating channel 280 and a second communicating channel 290, as depicted in FIG. 5. Since the configuration, function (action) and effect of those different from the first communicating channel 280 and the second communicating channel 290 are similar to those in the first embodiment, any detailed explanation therefor will be omitted.

The first communicating channel 280 and the second communicating channel 290 each have a tapered shape in which a radius "r" which is a dimension in the direction orthogonal to the stacking direction becomes smaller progressively as approaching closer toward the pressure chamber 31 along the stacking direction. For example, the first communicating channel 280 and the second communicating channel 290 each have a shape of a truncated cone (are frustoconical shaped).

Accordingly, the flow velocity of the liquid flowing through the first communicating channel 280 as the supplying path becomes faster progressively toward the pressure chamber 31. Due to this, any bubbles in the liquid easily flow into the pressure chamber 31. However, the flow velocity of the liquid flowing through the second communicating channel 290 as the returning path becomes slower as progressively separating away from the pressure chamber 31, and is fast on the side of the pressure chamber 31. With this, the bubbles in the liquid can be easily discharged or exhausted from the pressure chamber 31. Thus, it is possible to lower such a possibility that the bubbles in the liquid might enter into the nozzle 23.

A central axis 287 of the first communicating channel 280 and a central axis 297 of the second communicating channel 297 are parallel to each other and extend in the stacking direction. An inner circumferential surface 288 of the first communicating channel 280 and an inner circumferential surface 298 of the second communicating channel 290 are inclined with respect to the central axes 287 and 297, respectively, in a direction of inclination and are formed to be flat and smooth in the direction of inclination. With this, since any concavities and convexities are not formed in the inner circumferential surfaces 288 and 298, the liquid and any bubbles included in the liquid flow smoothly along the inner circumferential surfaces 288 and 298, thereby making it possible to suppress such a possibility that the flow of the liquid might be impeded due to any bubbles remaining in inner circumferential surfaces 288 and 298.

Further, in the stacking direction, a radius "r" of the first communicating channel 280 and a radius "r" of the second communicating channel 290 become smaller progressively from the upper side toward the lower side. Radii rb of a lower end 280*a* of the first communicating channel 280 and a lower end 290*a* of the second communicating channel 290 are smaller than radii ru of an upper end 280*b* of the first communicating channel 280 and an upper end 290*b* of the second communicating channel 290, respectively. For example, the radius rb is not more than half the radius ru. For example, the radius ru is 80 μm and the radius rb is 35 μm.

Accordingly, a spacing distance between close parts 288*a* and 298*a* in the inner circumferential surfaces 288 and 298 of the first and second communicating channels 280 and 290 becomes wider progressively as approaching closer toward the pressure chamber 31 along the stacking direction. With this, the distance in the stacking direction is made to be wider on the side of one ends (lower ends 280*a*, 290*a*), of the communicating channels 280 and 290, which are close to the individual channel in the stacking direction than on the side of the other ends (upper ends 280*b*, 290*b*) of the communicating channels 280 and 290. Accordingly, it is possible to prevent the liquid from leaking to the piezoelectric element 70 and to suppress any decrease in the discharge amount of the liquid, while suppressing any increase in the size of the head 11 as a whole.

Third Embodiment

Figure 6:
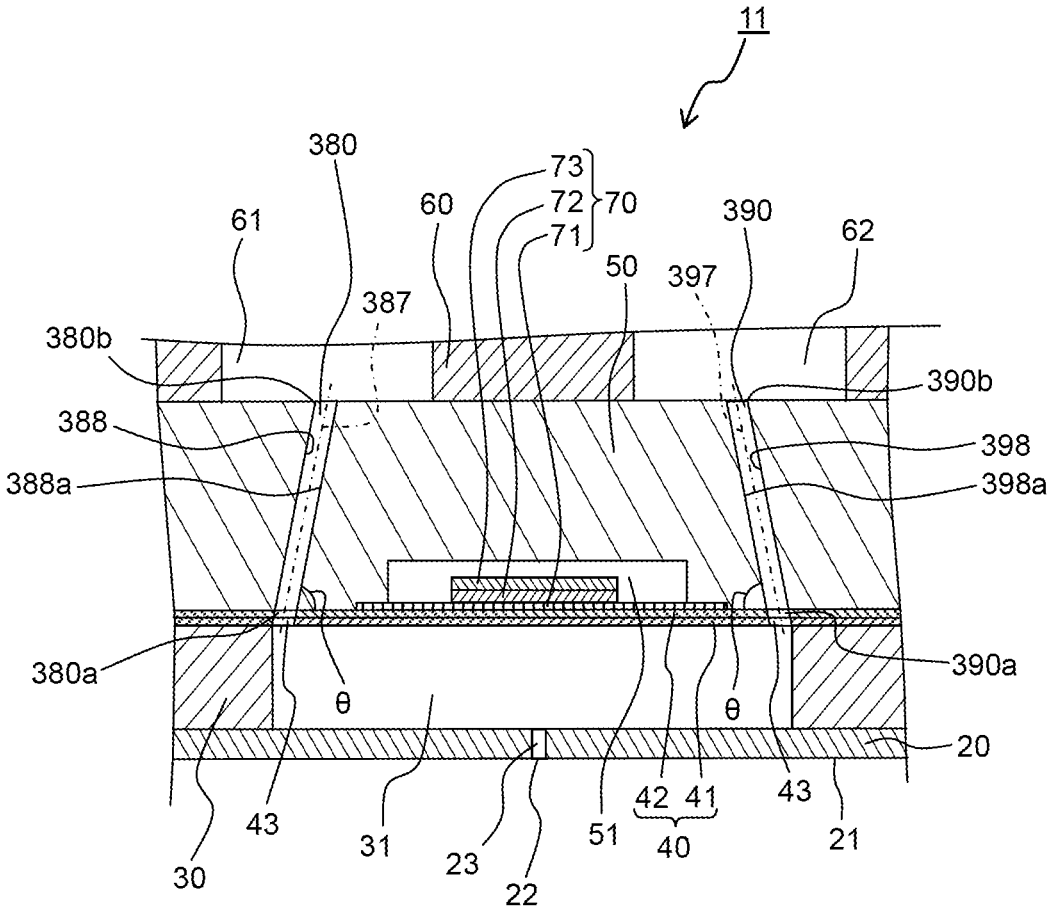
FIG. 6 is a cross-sectional view of a head according to a third embodiment.
Figure 6:
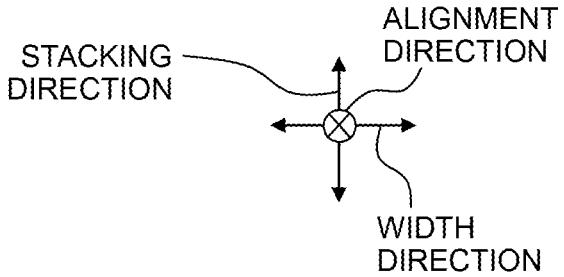

A head 11 according to a third embodiment is similar to the head 11 of the first embodiment as described above, except for the shapes of a pair of communicating channels (first communicating channel 380 and second communicating channel 390), as depicted in FIG. 6. Since the configuration, function (action) and effect of those different from the first communicating channel 380 and the second communicating channel 390 are similar to those in the first embodiment, any detailed explanation therefor will be omitted.

The first communicating channel 380 and the second communicating channel 390 extend while being inclined with respect to the stacking direction so that a spacing distance between a central axis 387 of the first communicating channel 380 and a central axis 397 of the second communicating channel 390 are wider progressively as approaching closer toward the pressure chamber 31 along the stacking direction. The first communicating channel 380 and the second communicating channel 390 each have a cylindrical shape and have diameters which are constant along the central axes 387 and 397, respectively. Accordingly, in the first communicating channel 380, the diameter of a lower end 380*a* is equal to the diameter of an upper end 380*b*; in the second communicating channel 390, the diameter of a lower end 390*a* is equal to the diameter of an upper end 390*b*.

An inner circumferential surface 388 of the first communicating channel 380 is parallel to the central axis thereof (first central axis 387) and is formed to be flat and smooth in a direction parallel to the first central axis 387. Further, an inner circumferential surface 398 of the second communicating channel 390 is parallel to the central axis thereof (second central axis 397) and is formed to be flat and smooth in a direction parallel to the second central axis 397. Accordingly, the liquid and any bubbles included in the liquid flow smoothly along the inner circumferential surfaces 388 and 398, thereby making it possible to suppress such a possibility that the flow of the liquid might be impeded due to any bubbles remaining in inner circumferential surfaces 388 and 398.

In the width direction, the first central axis 387 of the first communicating channel 380 is inclined in a direction separating away from the second communicating channel 390 progressively toward a lower side in the stacking direction, and the second central axis 397 of the second communicating channel 390 is inclined in a direction separating away from the first communicating channel 380 progressively toward the lower side in the stacking direction. An inclination angle θ of the first central axis 387 with respect to the width direction is same as an inclination angle θ of the second central axis 397 with respect to the width direction. For example, the inclination angle θ is 60°. As the inclination angle θ becomes greater, it is more easily to form the first communicating channel 380 and the second communicating channel 390.

Further, the first central axis 387 of the first communicating channel 380 is inclined in a direction approaching closer toward the second communicating channel 390 progressively as approaching closer toward the first manifold 61. Furthermore, the first central axis 397 of the second communicating channel 390 is inclined in a direction approaching closer toward the first communicating channel 380 progressively as approaching closer toward the second manifold 62. With this, it is possible to make the first manifold 61 and the second manifold 62 to be close to each other in the width direction, thereby realizing a small-sized head 11.

With this, the spacing distance (distance) between the first central axis 387 and the second central axis 397, and the spacing distance (distance D) between a close part 388*a* in the inner circumferential surface 388 of the first communicating channel 380 and a close part 398*a* in the inner circumferential surface 398 of the second communicating channel 390 are allowed to be wider progressively as approaching closer toward the pressure chamber 31 along the stacking direction. With this, this distance is allowed to be wider on the side of one end (lower ends 380*a*, 390*a*), of the communicating channels 380, 390, which are closer to the individual channel in the stacking direction than on the side of the other end (upper ends 380*b*, 390*b*) of the communicating channels 380, 390. Accordingly, it is possible to prevent the liquid from leaking to the piezoelectric element 70 and to suppress any decrease in the discharge amount of the liquid, while suppressing any increase in the size of the head 11 as a whole.

Fourth Embodiment

Figure 7:
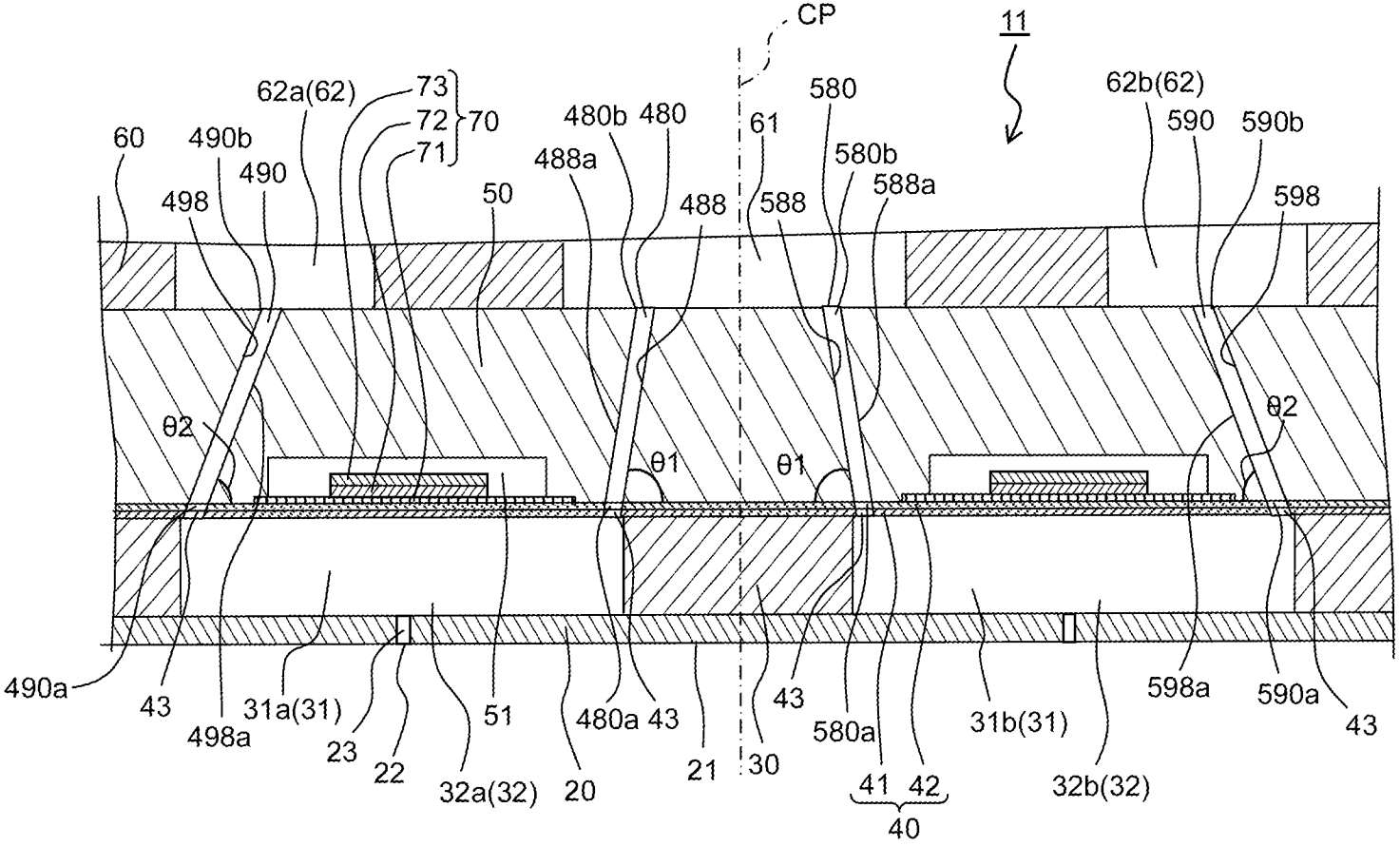
FIG. 7 is a cross-sectional view of a head according to a fourth embodiment.

A head 11 according to a fourth embodiment is similar to the head 11 of the first embodiment as described above, except for the shapes of first communicating channels 480, 580 and second communicating channels 490, 590, as depicted in FIG. 7. Since the configuration, function and effect of those different from the first communicating channels 480, 580 and the second communicating channels 490, 590 are similar to those in the first embodiment, any detailed explanation therefor will be omitted.

A pair of communicating channels (first communicating channel 480, second communicating channel 490) are connected to each of a plurality of pressure chambers 31 (first pressure chambers 31*a*) constructing a first pressure chamber array 32*a* (see FIG. 2). Further, a pair of communicating channels (first communicating channel 580, second communicating channel 590) are connected to each of a plurality of pressure chambers 31 (second pressure chambers 31*b*) constructing a second pressure chamber array 32*b* (see FIG. 2).

In the pair of communicating channels (first communicating channel 480, second communicating channel 490), in the width direction, the first communicating channel 480 is arranged to be closer to the second pressure chamber array 32*b* than the second communicating channel 490. Further, in the pair of communicating channels (first communicating channel 580, second communicating channel 590), in the width direction, the first communicating channel 580 is arranged to be closer to the first pressure chamber array 32*a* than the second communicating channel 590.

Accordingly, in the width direction, the first communicating channel 480 and the first communicating channel 580 are adjacent to each other, with a central position CP (see FIG. 2) between the first pressure chamber array 32*a* and the second pressure chamber array 32*b* being intervened therebetween, and are sandwiched between the second communicating channel 490 and the second communicating channel 590.

The first communicating channel 480 and the first communicating channel 580 are connected to a same first manifold 61, and the second communicating channel 490 and the second communicating channel 590 are connected to a pair of second manifolds 62 (second manifold 62*a*, second manifold 62*b*), respectively. The second manifold 62*a* and the second manifold 62*b* are arranged so as to sandwich the first manifold 61 therebetween in the width direction.

Each of the first communicating channels 480, 580 has a cylindrical shape, and has a diameter which is constant along a first central axis. Further, each of the second communicating channels 490, 590 has a cylindrical shape, and has a diameter which is constant along a second central axis.

The first communicating channel 480 is inclined linearly with respect to the stacking direction such that the first communicating channel 480 approaches closer to the first communicating channel 580 progressively in a direction from the side of the first pressure chamber 31*a* toward the side of the first manifold 61. The first communicating channel 580 is inclined linearly with respect to the stacking direction such that the first communicating channel 580 approaches closer to the first communicating channel 480 progressively from the side of the second pressure chamber 31*b* toward the side of the first manifold 61. Accordingly, the first communicating channel 480 and the first communicating channel 580 extend while being inclined so that each of the first communicating channels 480 and 580 approaches closer to the central position CP between the pressure chambers arrays 31*a* and 32*b*, progressively from the side of the pressure chamber 31 toward the side of the first manifold 61.

As described above, an upper end 480*b* of the first communicating channel 480 is arranged to be closer to the central position CP than a lower end 480*b* of the first communicating channel 480. An upper end 580*b* of the first communicating channel 580 is arranged to be closer to the central position CP than a lower end 580*b* of the first communicating channel 580. Accordingly, the first manifold 61 which is connected to the upper end 480*b* and the upper end 580*b* can be located closer toward the central position CP, thereby making it possible to realize a small-sized head 11.

The second communicating channel 490 as the one of second communicating channels is inclined linearly with respect to the stacking direction such that the second communicating channel 490 approaches closer to the second communicating channel 590 progressively in a direction from the side of the first pressure chamber 31*a* toward the side of the second manifold 62*b*. The second communicating channel 590 as the other of second communicating channels is inclined linearly with respect to the stacking direction such that the second communicating channel 590 approaches closer to the second communicating channel 490 progressively from the side of the second pressure chamber 31*b* toward the side of the second manifold 62*b*. Accordingly, the second communicating channel 490 and the second communicating channel 590 extend while being inclined so that each of the second communicating channels 490 and 590 approaches closer to the central position CP, progressively from the side of the pressure chamber 31 toward the side of the second manifold 62.

As described above, an upper end 490*b* of the second communicating channel 490 is to be closer to the central position CP than a lower end 490*a* of the second communicating channel 490. An upper end 590*b* of the second communicating channel 590 is arranged to be closer to the central position CP than a lower end 590*b* of the second communicating channel 590. Accordingly, the second manifold 62*b* which is connected to the upper end 490*b* and the second manifold 62*b* which is connected to the upper end 590*b* can be located closer toward the central position CP, thereby making it possible to realize a small-sized head 11.

Further, the first communicating channel 480 and the second communicating channel 490 are inclined with respect to a mutually same direction, and the first communicating channel 580 and the second communicating channel 590 are inclined with respect to a mutually same direction. Note, however, that an inclination angle of the close parts 488*a*, 588*a* in the inner circumferential surfaces 488, 588 of the first communicating channels 480, 580, respectively, with respect to the width direction (first inclination angle θ1) is greater than an inclination angle of the close parts 498*a*, 598*a* in the inner circumferential surfaces 498, 598 of the second communicating channels 490, 590, respectively, with respect to the width direction (second inclination angle θ2). For example, the first inclination angle θ1 is 70° and the second inclination angle θ2 is 60°.

With this, the distance between the close part 488*a* of the first communicating channel 480 and the close part 498*a* of the second communicating channel 490, and the distance between the close part 588*a* of the first communicating channel 580 and the close part 598*a* of the second communicating channel 590 are allowed to be wider progressively as approaching closer toward the pressure chamber 31 along the stacking direction. With this, this distance is allowed to be wider on the side of one end (lower ends 480*a*, 490*a*) of the communicating channels 480, 490 which are closer to the individual channel in the stacking direction than on the side of the other end (upper ends 480*b*, 490*b*) of the communicating channels 480, 490; and this distance is allowed to be wider on the side of one end (lower ends 580*a*, 590*a*) of the communicating channels 580, 590 which are closer to the individual channel in the stacking direction than on the side of the other end (upper ends 580*b*, 590*b*) of the communicating channels 580, 590. Accordingly, it is possible to prevent the liquid from leaking to the piezoelectric element 70 and to suppress any decrease in the discharge amount of the liquid, while suppressing any increase in the size of the head 11 as a whole.

Second Modification

Figure 8:
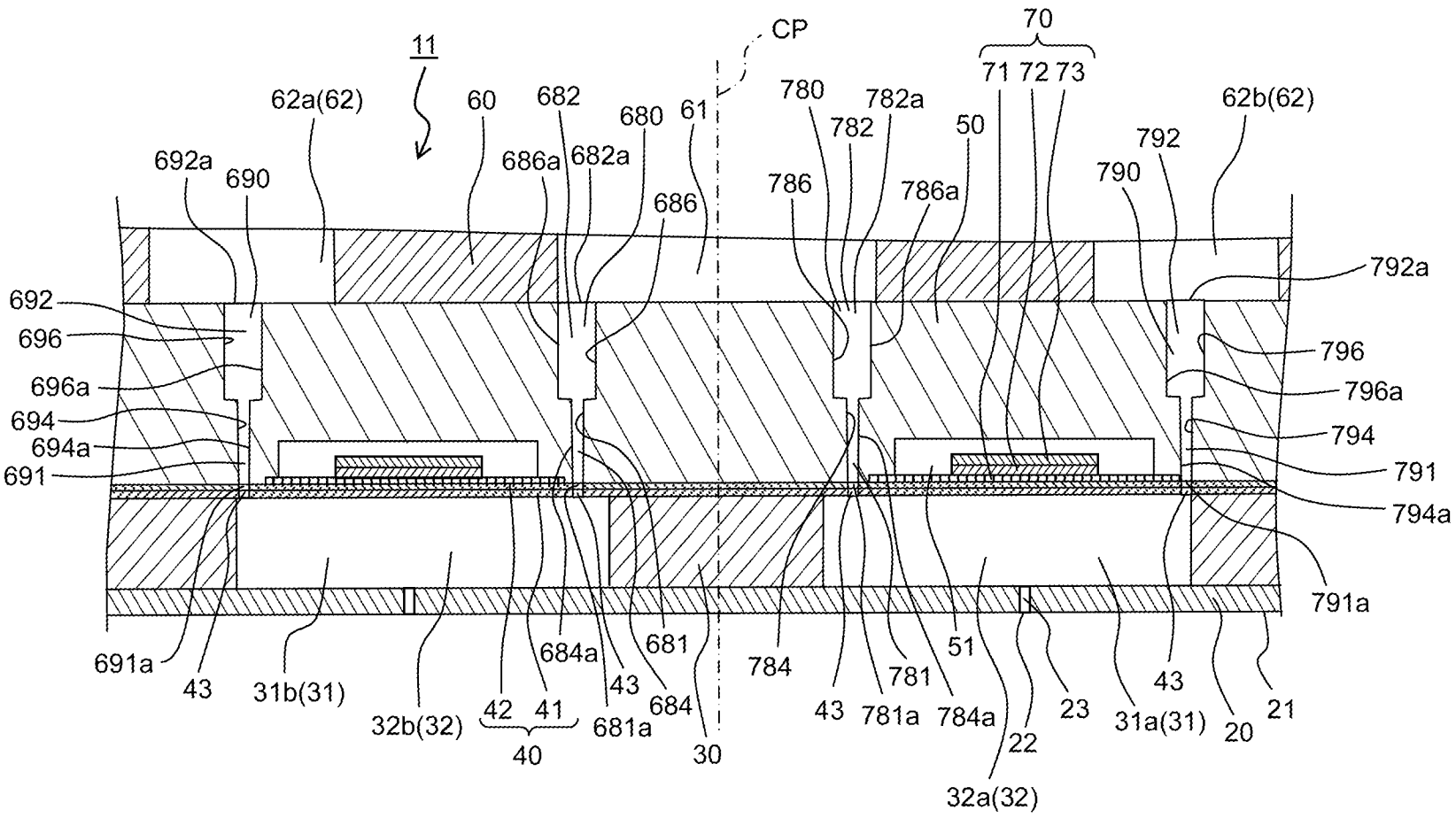
FIG. 8 is a cross-sectional view of a head according to a second modification.

In the head 11 depicted in FIG. 7, the first communicating channel 480 and the first communicating channel 580 are connected to the same first manifold 61. Similarly to this configuration, it is allowable that the pair of communicating channels 80, 90 depicted in FIG. 3 is provided as first communicating channels 680, 780 and second communicating channels 690, 790 as depicted in FIG. 8; and that the first communicating channels 680, 780 are connected to a same first manifold 61.

The first communicating channels 680, 780 and the second communicating channels 690, 790 are provided with first channel parts 681, 691, 781 and 791, and second channel parts 682, 692, 782, 792, respectively; and a first radius r1 of each of first channel parts 681, 691, 781 and 791 is smaller than a second radius r2 of each of the second channel parts 682, 692, 782, 792. Further, lower ends 681*a*, 691*a*, 781*a* and 791*a* of the first communicating channels 680, 780 and of the second communicating channels 690, 790, respectively, each have a diameter which is smaller than that of each of upper ends 682*a*, 692*a*, 782*a* and 792*a* of the first communicating channels 680, 780 and of the second communicating channels 690, 790, respectively.

Accordingly, a first distance between a first close part 684*a* of an inner circumferential surface 684 of the first channel part 681 and a first close part 694*a* of an inner circumferential surface 694 of the first channel part 691 is wider than a second distance between a second close part 686*a* of an inner circumferential surface 686 of the second channel part 682 and a second close part 696*a* of an inner circumferential surface 696 of the second channel part 692. Similarly, a first distance between a first close part 784*a* of an inner circumferential surface 784 of the first channel part 781 and a first close part 794*a* of an inner circumferential surface 794 of the first channel part 791 is wider than a second distance between a second close part 786*a* of an inner circumferential surface 786 of the second channel part 782 and a second close part 796*a* of an inner circumferential surface 796 of the second channel part 792.

Figure 9:
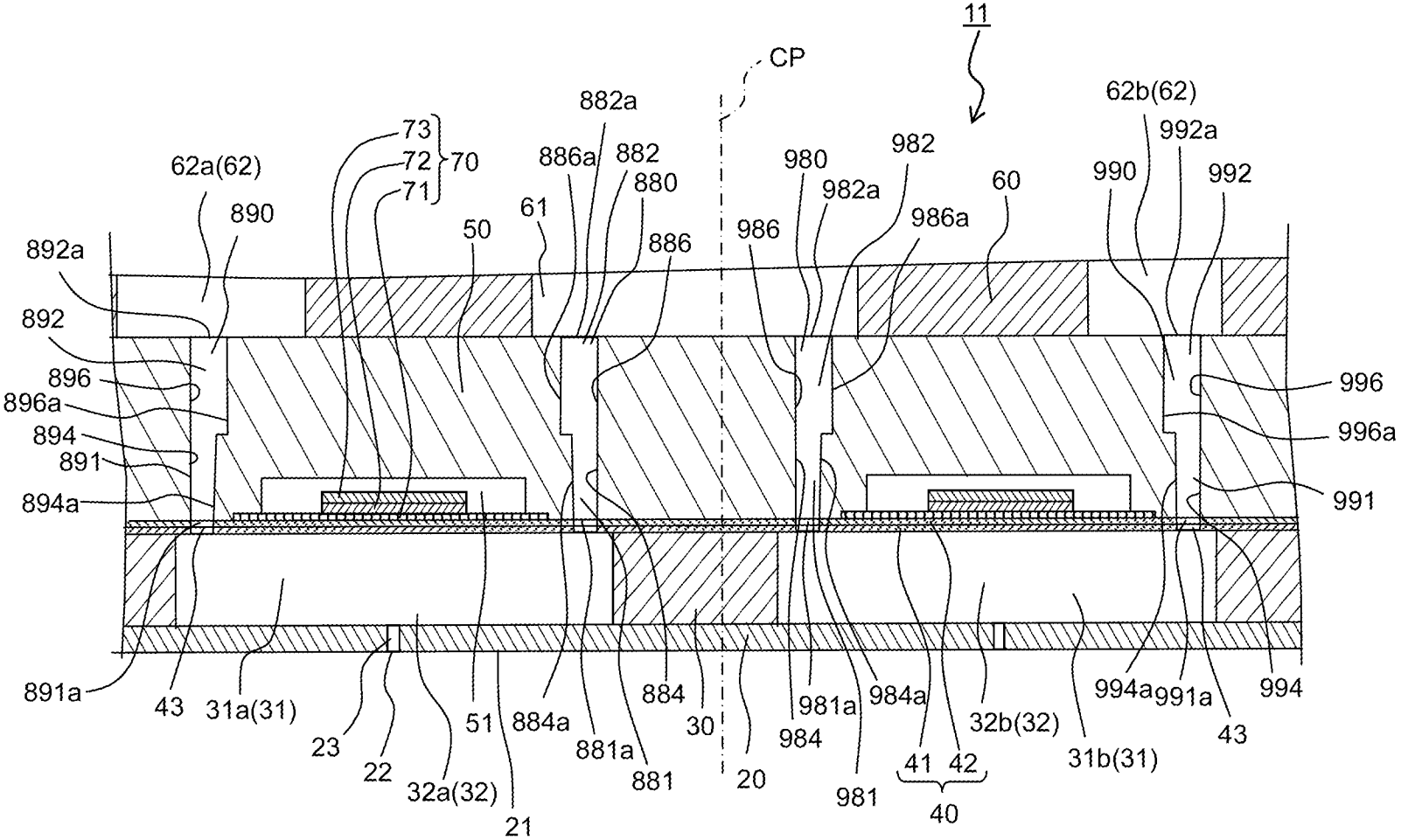
FIG. 9 is a cross-sectional view of a head according to another example of the second modification.

Further, it is allowable that the communicating channels 180, 190 depicted in FIG. 4 are provided as first communicating channels 880, 980 and second communicating channels 890, 990 as depicted in FIG. 9; and that the first communicating channel 880, 980 are connected to a same first manifold 61.

The first communicating channels 880, 980 and the second communicating channels 890, 990 are provided with first channel parts 881, 891, 981, 991, and second channel parts 882, 892, 982, 992, respectively; and a first radius r1 of each of first channel parts 881, 891, 981, 991 is smaller than a second radius r2 of each of the second channel parts 882, 892, 982, 992. Further, lower ends 881*a*, 891*a*, 981*a* and 991*a* of the first communicating channels 880, 980 and of the second communicating channels 890, 990, respectively, each have a diameter which is smaller than that of each of upper ends 882*a*, 892*a*, 982*a* and 992*a* of the first communicating channels 880, 980 and of the second communicating channels 890, 990, respectively.

Accordingly, a first distance between a first close part 884*a* of an inner circumferential surface 884 of the first channel part 881 and a first close part 894*a* of an inner circumferential surface 894 of the first channel part 891 is wider than a second distance between a second close part 886*a* of an inner circumferential surface 886 of the second channel part 882 and a second close part 896*a* of an inner circumferential surface 896 of the second channel part 892. Similarly, a first distance between a first close part 984*a* of an inner circumferential surface 984 of the first channel part 981 and a first close part 994*a* of an inner circumferential surface 994 of the first channel part 991 is wider than a second distance between a second close part 986*a* of an inner circumferential surface 986 of the second channel part 982 and a second close part 996*a* of an inner circumferential surface 996 of the second channel part 992.

Third Modification

Figure 10:
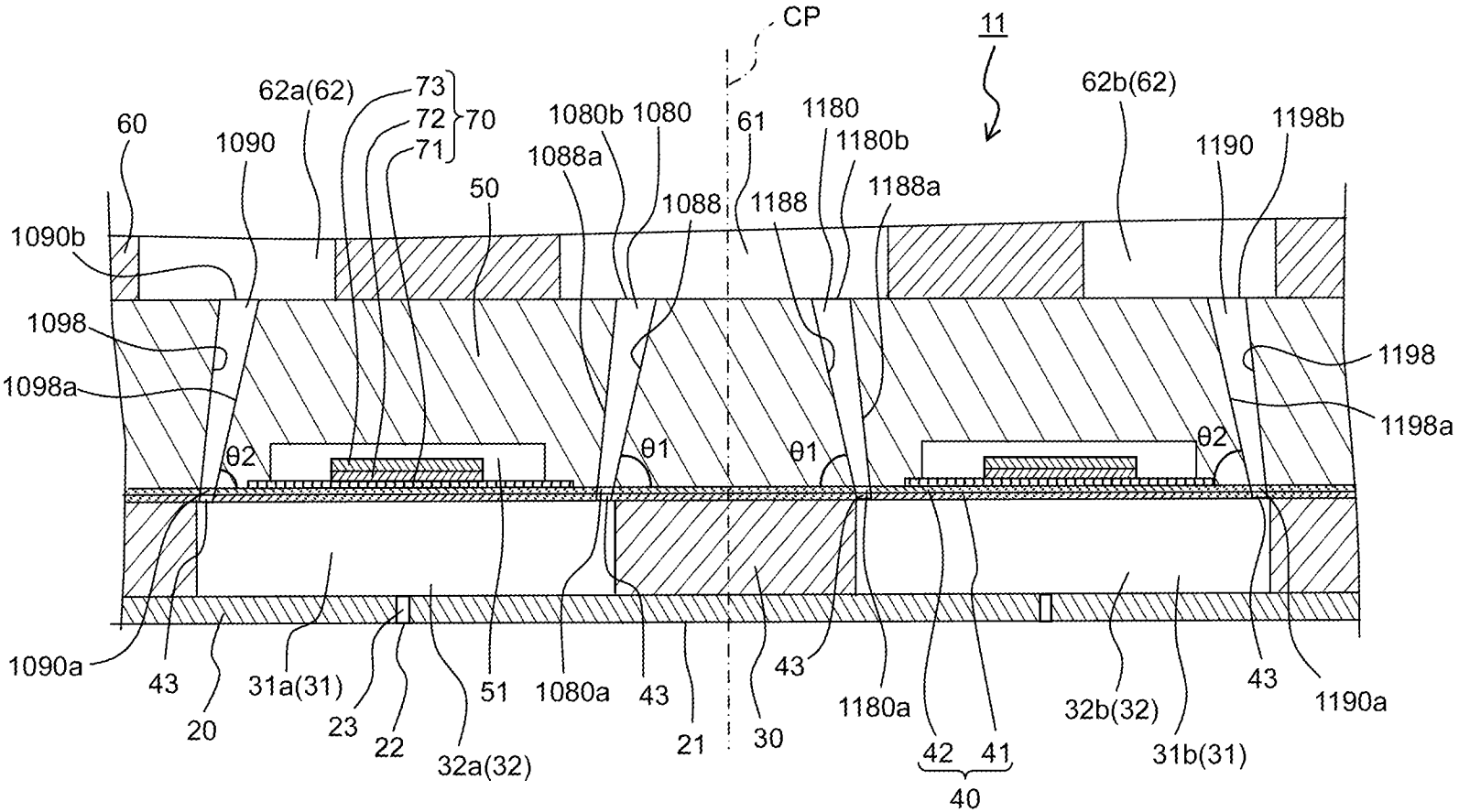
FIG. 10 is a cross-sectional view of a head according to a third modification.

It is allowable that the pair of communicating channels 280, 290 of FIG. 5 is used as first communicating channels 1080, 1180 and second communicating channels 1090, 1190 as depicted in FIG. 10, and these communicating channels 1080, 1180, 1090 and 1190 are inclined in a similar manner as in FIG. 7. The first communicating channels 1080, 1180 and the second communicating channels 1090, 1190 each have a tapered shape in which a diameter which is a dimension in the direction orthogonal to the stacking direction becomes smaller progressively as approaching closer toward the pressure chamber 31 along the stacking direction. With this, the diameter of each of lower ends 1081*a*, 1091*a* and lower ends 1181*a*, 1191*a* of the first communicating channels 1080, 1180 and of the second communicating channels 1090, 1190, respectively, is smaller than a diameter of each of upper ends 1082*a*, 1092*a* and upper ends 1182*a*, 1192*a* of the first communicating channels 1080, 1180 and of the second communicating channels 1090, 1190, respectively.

Accordingly, even in such a case that a first inclination angle θ1 of the first communicating channel 1080 is made to be equal to a second inclination angle θ2 of the second communicating channel 1090, a spacing distance between a close part 1088*a* of an inner circumferential surface 1088 of the first communicating channel 1080 and a close part 1098*a* of an inner circumferential surface 1098 of the second communicating channel 1090 becomes wider progressively as approaching closer toward the pressure chamber 31 along the stacking direction. Further, similarly to the above, even in such a case that a first inclination angle θ1 of the first communicating channel 1180 is made to be equal to a second inclination angle θ2 of the second communicating channel 1190, a spacing distance between a close part 1188*a* of an inner circumferential surface 1188 of the first communicating channel 1180 and a close part 1198*a* of an inner circumferential surface 1198 of the second communicating channel 1190 becomes wider progressively as approaching closer toward the pressure chamber 31 along the stacking direction.

Fifth Embodiment

Figure 11:
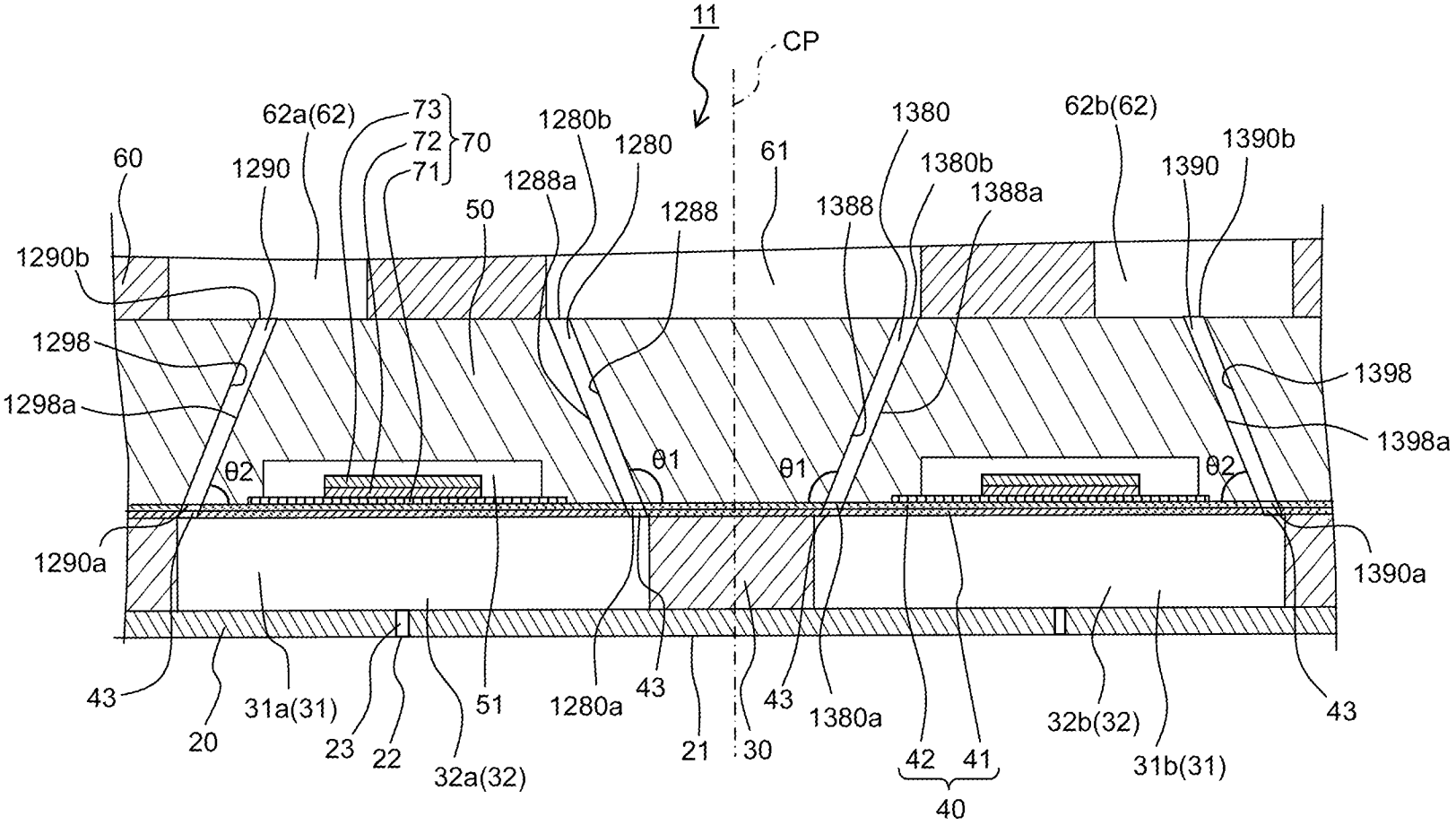
FIG. 11 is a cross-sectional view of a head according to a fifth embodiment.

A head 11 according to a fifth embodiment is similar to the head 11 of the above-described embodiment, except for the shapes of first communicating channel 1280, 1380 and second communicating channels 1290, 1390 as depicted in FIG. 11. Since the configuration, function and effect of those different from the first communicating channel 1280, 1380 and the second communicating channels 1290, 1390 are similar to those in the above-describe embodiment, any detailed explanation therefor will be omitted.

The first communicating channel 1280 is inclined linearly with respect to the stacking direction so that the first communicating channel 1280 is separated away farther from the first communicating channel 1380 progressively from a side of the first pressure chamber 31*a* toward a side of the first manifold 61. The first communicating channel 1380 is inclined linearly with respect to the stacking direction so that the first communicating channel 1380 is separated away farther from the first communicating channel 1280 progressively from a side of the second pressure chamber 31*b* toward the side of the first manifold 61. Accordingly, the first communicating channel 1280 and the first communicating channel 1380 extend while being inclined so that each of the first communicating channels 1280 and 1380 is separated away farther from a central position CP between the first pressure chamber array 31*a* and the second pressure chamber array 32*a*, progressively from the side of the pressure chamber 31 toward the side of the first manifold 61.

In such a manner, in the width direction, an upper end 1280*b* of the first communicating channel 1280 is separated farther away from the central position CP than a lower end 1280*a* of the first communicating channel 1280; in the width direction, an upper end 1380*b* of the first communicating channel 1380 is separated farther away from the central position CP than a lower end 1380*a* of the first communicating channel 1380. With this, it is possible to widen the first manifold 61 connected with respect to the upper end 1280*b* and the upper end 1380*b*, thereby making it possible to make the cross-sectional area of the first manifold 61 to be great, without increasing the height of the first manifold 61. Accordingly, it is possible to secure the volume (capacity) of the first manifold 61 with respect to the liquid flowing between one piece of the first manifold 61 and two pieces of the communicating channels, namely, the first communicating channels 1280 and 1380, without making the height of the head 11 to be greater.

Further, the second communicating channel 1290, as one of the two second communicating channels, is inclined linearly with respect to the stacking direction so that the second communicating channel 1290 approaches closer to the second communicating channel 1390 as the other of the two second communicating channels progressively in a direction from the side of the first pressure chamber 31*a* toward the side of the second manifold 62*a*. Further, the second communicating channel 1390, as the other of the two second communicating channels, is inclined linearly with respect to the stacking direction so that the second communicating channel 1390 approaches closer to the second communicating channel 1290 as the one of the two second communicating channels progressively in a direction from the side of the second pressure chamber 31*b* toward the side of the second manifold 62*b*. Accordingly, the second communicating channel 1290 and the second communicating channel 1390 extend while being inclined so that each of the second communicating channels 1290 and 1390 approaches closer (nearer) to the central position CP, progressively from the side of the pressure chamber 31 toward the side of the second manifold 62.

As described above, an upper end 1290*b* of the second communicating channel 1290 as one of the two second communicating channels is arranged to be closer to the central position CP than a lower end 1290*b* of the second communicating channel 1290. An upper end 1390*b* of the second communicating channel 1390 as the other of the two second communicating channels is arranged to be closer to the central position CP than a lower end 1390*a* of the second communicating channel 1390. Accordingly, the second manifold 62*a* which is connected to the upper end 1290*b* and the second manifold 62*b* which is connected to the upper end 1390*b* can be located closer toward the central position CP, thereby making it possible to realize a small-sized head 11.

Accordingly, a distance between a close part 1288*a* of an inner circumferential surface 1288 of the first channel part 1280 and a close part 1298*a* of an inner circumferential surface 1298 of the second channel part 1290, and a distance between a close part 1388*a* of an inner circumferential surface 1388 of the first channel part 1380 and a close part 1398*a* of an inner circumferential surface 1398 of the second channel part 1390 become wider progressively as approaching closer toward the pressure chamber 31 along the stacking direction. With this, this distance is made to be wider on the side of one ends (lower ends 1280*a*, 1290*a*), of the communicating channels 1280 and 1290, which are close to the individual channel in the stacking direction than on the side of the other ends (upper ends 1280*b*, 1290*b*) of the communicating channels 1280 and 1290; and the distance is made to be wider on the side of one ends (lower ends 1380*a*, 1390*a*), of the communicating channels 1380 and 1390, which are close to the individual channel in the stacking direction than on the side of the other ends (upper ends 1380*b*, 1390*b*) of the communicating channels 1380 and 1390. Accordingly, it is possible to prevent the liquid from leaking to the piezoelectric element 70 and to suppress any decrease in the discharge amount of the liquid, while suppressing any increase in the size of the head 11 as a whole.

Note that the communicating channels of the first embodiment, the communication channels of the modification of the first embodiment (first modification), and the communicating channels of the second embodiment may be applied to the fifth embodiment.

Numerous improvement and/or another embodiment(s) of the present disclosure will be apparent to a person of skilled art, from the above explanation. Accordingly, the above explanation should be interpreted only as an example, and is provided for the purpose of teaching, to the person of skilled art, a suitable or optimum aspect for embodying the present disclosure. The details of the configuration and/or function of the present disclosure may be substantially changed, without departing from the spirit of the present disclosure.

The head according to the present disclosure is effective as a head, etc., which is capable of preventing the liquid from leaking to the piezoelectric element and suppressing any decrease in the discharge amount of the liquid, while suppressing any increase in the size of the head as a whole.

What is claimed is:

1. A liquid discharge head comprising:

a first plate including an individual channel communicating with a nozzle and including a pressure chamber;

a second plate stacked, in a stacking direction, on the first plate on a side opposite to the nozzle;

a vibration plate stacked between the first and second plates in the stacking direction; and a piezoelectric element which is arranged in the vibration plate at a position overlapping, as seen from the stacking direction, with the pressure chamber of the individual channel, wherein the second plate includes:

an accommodating space accommodating the piezoelectric element, and a pair of communicating channels arranged to sandwich the accommodating space therebetween, each of the pair of communicating channels extending in the stacking direction, and communicating with the individual channel; and a spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction, wherein each of the pair of communicating channels has a tapered shape in which a dimension in a radial direction, which is orthogonal to the stacking direction, of each of the pair of communicating channels becomes smaller progressively as approaching closer toward the individual channel along the stacking direction.

2. The liquid discharge head according to claim 1, wherein in the stacking direction, a dimension in the radial direction of each of the one ends of the pair of communicating channels is not more than half a dimension in the radial direction of one of the other ends, of the pair of communicating channels, which are far from the individual channel than the one ends.

3. The liquid discharge head according to claim 1, wherein the pair of inner circumferential surfaces of the pair of communicating channels are each formed to be flat and smooth.

4. The liquid discharge head according to claim 1, wherein the pair of communicating channels are connected respectively to end parts in a longitudinal direction of the pressure chamber.

5. A liquid discharge head comprising:

a first plate including an individual channel communicating with a nozzle and including a pressure chamber;

a second plate stacked, in a stacking direction, on the first plate on a side opposite to the nozzle;

a vibration plate stacked between the first and second plates in the stacking direction; and a piezoelectric element which is arranged in the vibration plate at a position overlapping, as seen from the stacking direction, with the pressure chamber of the individual channel, wherein the second plate includes:

an accommodating space accommodating the piezoelectric element, and a pair of communicating channels arranged to sandwich the accommodating space therebetween, each of the pair of communicating channels extending in the stacking direction, and communicating with the individual channel; and a spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction, wherein the pair of communicating channels extend while being inclined with respect to the stacking direction so that a spacing distance between central axes between the pair of communicating channels becomes wider progressively as approaching closer toward the individual channel along the stacking direction.

6. The liquid discharge head according to claim 5, wherein the pair of communicating channels are connected respectively to end parts in a longitudinal direction of the pressure chamber.

7. A liquid discharge head comprising:

a first plate including an individual channel communicating with a nozzle and including a pressure chamber;

a second plate stacked, in a stacking direction, on the first plate on a side opposite to the nozzle;

a vibration plate stacked between the first and second plates in the stacking direction; and a piezoelectric element which is arranged in the vibration plate at a position overlapping, as seen from the stacking direction, with the pressure chamber of the individual channel, wherein the second plate includes:

an accommodating space accommodating the piezoelectric element, and a pair of communicating channels arranged to sandwich the accommodating space therebetween, each of the pair of communicating channels extending in the stacking direction, and communicating with the individual channel; and a spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction, wherein the individual channel is provided as a plurality of individual channels which include a plurality of pressure chambers, respectively, and which are formed in the first plate;

the plurality of pressure chambers are arranged so as to form a first pressure chamber array and a second pressure chamber array which are arranged side by side in a width direction of the pressure chambers;

the pair of communicating channels include one pair of communicating channels and another pair of communicating channels;

the liquid discharge head further comprises:

a first manifold which is connected to first communicating channels of the one and the another pairs communicating channels, respectively, in a case that the one pair of communicating channels are connected to a pressure chamber which is included in the plurality of pressure chambers and which constructs the first pressure chamber array and that the another pair of communicating channels are connected to a pressure chamber which is included in the plurality of pressure chambers and which constructs the second pressure chamber array, one of the first communicating channels being a communicating channel included in the one pair of communicating channels and located closely to the second pressure chamber array, and the other of the first communicating channels being a communicating channel included in the another pair of communicating channels and located closely to the first pressure chamber array; and the first communicating channels extend while being inclined so that each of the first communicating channels approaches closer to a central position between the first and second pressure chamber arrays, progressively from a side of the pressure chamber toward a side of the first manifold.

8. The liquid discharge head according to claim 7, further comprising a second manifold and another second manifold which are connected to second communicating channels, respectively, of the one and the another pairs communicating channels, respectively, in a case that the one pair of communicating channels are connected to the pressure chamber which is included in the plurality of pressure chambers and which constructs the first pressure chamber array and that the another pair of communicating channels are connected to the pressure chamber which is included in the plurality of pressure chambers and which constructs the second pressure chamber array, one of the second communicating channels being a communicating channel included in the one pair of communicating channels and located far from the second pressure chamber array, and the other of the second communicating channels being a communicating channel included in the another pair of communicating channels and located far from the first pressure chamber array; and the second communicating channels extend while being inclined so that each of the second communicating channels approaches closer to the central position between the first and second pressure chamber arrays, progressively from the side of the pressure chamber toward a side of one of the second manifold and the another second manifold.

9. The liquid discharge head according to claim 8, wherein the first communicating channels are supplying paths via each of which the liquid flows from the first manifold to one of the individual channels, and the second communicating channels are returning paths via each of which the liquid flows from one of the individual channels toward the second manifold or the another second manifold corresponding thereto; and the returning paths are connected to central parts in a short direction of the second manifold and the another manifolds, respectively.

10. The liquid discharge head according to claim 7, wherein the pair of communicating channels are connected respectively to end parts in a longitudinal direction of the pressure chamber.

11. A liquid discharge head comprising:

a first plate including an individual channel communicating with a nozzle and including a pressure chamber;

a second plate stacked, in a stacking direction, on the first plate on a side opposite to the nozzle;

a vibration plate stacked between the first and second plates in the stacking direction; and a piezoelectric element which is arranged in the vibration plate at a position overlapping, as seen from the stacking direction, with the pressure chamber of the individual channel, wherein the second plate includes:

an accommodating space accommodating the piezoelectric element, and a pair of communicating channels arranged to sandwich the accommodating space therebetween, each of the pair of communicating channels extending in the stacking direction, and communicating with the individual channel; and a spacing distance between mutually close parts in a pair of inner circumferential surfaces of the pair of communicating channels, respectively, is greater on a side of one ends in the stacking direction of the pair of communicating channels than on a side of the other ends in the stacking direction of the pair of communicating channels, the one ends being close to the individual channel in the stacking direction, wherein the individual channel is provided as a plurality of individual channels which include a plurality of pressure chambers, respectively, and which are formed in the first plate;

the plurality of pressure chambers are arranged so as to form a first pressure chamber array and a second pressure chamber array which are arranged side by side in a width direction of the pressure chambers;

the pair of communicating channels include one pair of communicating channels and another pair of communicating channels;

the liquid discharge head further comprises:

a first manifold which is connected to first communicating channels of the one and the another pairs communicating channels, respectively, in a case that the one pair of communicating channels are connected to a pressure chamber which is included in the plurality of pressure chambers and which constructs the first pressure chamber array and that the another pair of communicating channels are connected to a pressure chamber which is included in the plurality of pressure chambers and which constructs the second pressure chamber array, one of the first communicating channels being a communicating channel included in the one pair of communicating channels and located closely to the second pressure chamber array, and the other of the first communicating channels being a communicating channel included in the another pair of communicating channels and located closely to the first pressure chamber array; and the first communicating channels extend while being inclined so that each of the first communicating channels is separated away farther from a central position between the first and second chamber arrays, progressively from a side of the pressure chamber toward a side of the first manifold.

12. The liquid discharge head according to claim 11, further comprising a second manifold and another second manifold which are connected to second communicating channels, respectively, of the one and the another pairs communicating channels, respectively, in a case that the one pair of communicating channels are connected to the pressure chamber which is included in the plurality of pressure chambers and which constructs the first pressure chamber array and that the another pair of communicating channels are connected to the pressure chamber which is included in the plurality of pressure chambers and which constructs the second pressure chamber array, one of the second communicating channels being a communicating channel included in the one pair of communicating channels and located far from the second pressure chamber array, and the other of the second communicating channels being a communicating channel included in the another pair of communicating channels and located far from the first pressure chamber array; and the second communicating channels extend while being inclined so that each of the second communicating channels approaches closer to the central position between the first and second pressure chamber arrays, progressively from the side of the pressure chamber toward a side of one of the second manifold and the another second manifold.

13. The liquid discharge head according to claim 12, wherein the first communicating channels are supplying paths via each of which the liquid flows from the first manifold to one of the individual channels, and the second communicating channels are returning paths via each of which the liquid flows from one of the individual channels toward the second manifold or the another second manifold corresponding thereto; and the returning paths are connected to central parts in a short direction of the second manifold and the another manifolds, respectively.

14. The liquid discharge head according to claim 11, wherein the pair of communicating channels are connected respectively to end parts in a longitudinal direction of the pressure chamber.

* * * * *